US007972491B2

(12) United States Patent
Niinae

(10) Patent No.: US 7,972,491 B2
(45) Date of Patent: Jul. 5, 2011

(54) METHOD FOR IMPARTING HYDROGEN RESISTANCE TO ARTICLES

(75) Inventor: Toshinobu Niinae, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 924 days.

(21) Appl. No.: 11/578,404

(22) PCT Filed: Apr. 15, 2005

(86) PCT No.: PCT/JP2005/007309

§ 371 (c)(1),
(2), (4) Date: Aug. 23, 2007

(87) PCT Pub. No.: WO2005/100641

PCT Pub. Date: Oct. 27, 2005

(65) Prior Publication Data

US 2008/0131708 A1 Jun. 5, 2008

(30) Foreign Application Priority Data

Apr. 15, 2004 (JP) ..... 2004-119959
Aug. 31, 2004 (JP) ..... 2004-252038

(51) Int. Cl.
*C25D 3/38* (2006.01)
*C25D 3/02* (2006.01)
*C25D 5/48* (2006.01)

(52) U.S. Cl. ..... 205/104; 204/291; 204/296

(58) Field of Classification Search ..... None
See application file for complete search history.

(56) References Cited

U.S. PATENT DOCUMENTS 4,814,009 A * 3/1989 Kondo et al. ..... 106/1.23
4,910,072 A * 3/1990 Morgan et al. ..... 428/212
5,024,858 A * 6/1991 Burch ..... 427/123
5,261,154 A * 11/1993 Ferrier et al. ..... 29/830
5,302,464 A * 4/1994 Nomura et al. ..... 428/551
5,302,469 A * 4/1994 Sugenoya et al. ..... 428/812
5,311,660 A * 5/1994 Alpaugh et al. ..... 29/852
6,099,711 A * 8/2000 Dahms et al. ..... 205/101
6,284,652 B1 * 9/2001 Charneski et al. ..... 438/653
7,115,196 B2 * 10/2006 Chen et al. ..... 205/82
7,230,188 B1 * 6/2007 En et al. ..... 174/257

(Continued)

FOREIGN PATENT DOCUMENTS

JP 2612494 2/1997

(Continued)

OTHER PUBLICATIONS

"Plating Technology" (Dian Du II Shu), Cheng Du Shi Ke Ji Jiao Liu Zhan Biao Mian Chu Li Yan Jiu Hui, Nov. 30, 1982, pp. I, 1-2, 243-244, 256-257 (with English translation of the descriptions).
Chinese Office Action dated Mar. 27, 2009.

*Primary Examiner* — Timothy M Speer
*Assistant Examiner* — Jason L Savage
(74) *Attorney, Agent, or Firm* — Kratz, Quintos & Hanson, LLP

(57) ABSTRACT

A simple and low cost method for imparting excellent hydrogen resistance to various types of articles such as a rare earth metal-based permanent magnet. A method for imparting hydrogen resistance to an article of the present invention is characterized by forming a metal coating film by pulse plating on the surface of the article.

4 Claims, 2 Drawing Sheets

U.S. PATENT DOCUMENTS

| | | | | |
|---|---|---|---|---|
| 2005/0067292 | A1* | 3/2005 | Thompson et al. | 205/118 |
| 2006/0283716 | A1* | 12/2006 | Hafezi et al. | 205/291 |
| 2007/0125657 | A1* | 6/2007 | Sun et al. | 205/205 |
| 2007/0269679 | A1* | 11/2007 | Niinae | 428/674 |

FOREIGN PATENT DOCUMENTS

| | | |
|---|---|---|
| JP | 2000-500529 | 1/2000 |
| JP | 2002-212775 | 7/2002 |
| JP | 2003-257721 | 9/2003 |

* cited by examiner

METHOD FOR IMPARTING HYDROGEN RESISTANCE TO ARTICLES

TECHNICAL FIELD

The present invention relates to a method for imparting hydrogen resistance to various types of articles such as a rare earth metal-based permanent magnet.

BACKGROUND ART

As a means for preventing global warming attributed to $CO_2$ emission, hydrogen gas fuels are attracting attention. today as alternatives for oil and coal fuels (fossil fuels) that have depended so far in relation with environmental technology, and development of various systems such as power generation, cooling, and storage using hydrogen gas as fuels has been energetically carried out. In due course of developing such systems, an expansion in the applications of rare earth metal-based permanent magnets, such as R—Fe—B based permanent magnets represented by a Nd—Fe—B based permanent magnet, is expected because the magnets are made from low cost materials that are abundant in resources and have superior magnetic characteristics, and if embedded in circulation motors and magnetic sensors that are used in supplying or transporting hydrogen gases, they can realize low cost compact systems.

In the case of considering extending the application of rare earth metal-based permanent magnets in the fields using hydrogen gas as fuels, the magnets should have hydrogen resistance during usage which resist to environments of high hydrogen gas pressure. However, considering a case of an R—Fe—B based permanent magnet, for instance, the magnet possesses high hydrogen absorptivity as is clear from the fact that this magnet is manufactured through the process of finely dividing magnetic powder by pressurized crushing using hydrogen gas. Accordingly, in case hydrogen gas is present in the environment the magnet is used, there may be assumed an environment in which the hydrogen gas pressure may be 100 kPa or higher regardless of whether the environment is made up of hydrogen gas alone or formed of a mixed gas of hydrogen gas and other gases; in such a case, there is such a problem that, if sufficient hydrogen resistance should not be imparted to the magnet, the magnet may absorb hydrogen and become brittle due to the reaction of R with hydrogen, thereby causing the formation of hydrides or an exothermic reaction, finally ending in the disruption of the magnet.

As a method for imparting hydrogen resistance to rare earth metal-based permanent magnets, there is proposed, for instance, a method according to patent reference 1 below, which comprises forming a Cu coating film on the surface of the magnet, and further forming on the surface thereof a metal coating film made of a metal more base than Cu, such as a Ni coating film. However, this method is merely a method for preventing the magnet from absorbing hydrogen gas that is generated during the formation of the metal coating film on the surface of the magnet. Accordingly, simple adoption of such a layered structure is not sufficient for imparting hydrogen resistance to the magnet for use under high hydrogen gas pressure environment such as 100 kPa or higher; in particular, under such an environment that hydrogen is diffused and evolved repeatedly to the metal coating film, there is a problem as such that the generation of blistering and peeling off of the coating film is provoked, thereby leading to an abrupt rupture of the magnet and the metal coating film at an early stage, and a disruption of the magnet. Further according to patent reference 2 below, there is proposed a method which comprises forming, on the surface of the magnet, a multilayered metal coating film having 4 layers or more of Ni coating film(s) and Cu coating film(s) as the constituent coating films, and the total film thickness is in a range of from 15 μm to 70 μm, provided that the thickness of the Cu coating film(s) accounts for 30% or more of the total film thickness. However, this method suffers problems such as a reduction in effective volume of the magnet and an increase in cost.

Patent reference 1: JP-A-5-29119

Patent reference 2: JP-A-2003-166080

DISCLOSURE OF THE INVENTION

Problems that the Invention is to Solve

Accordingly, an object of the present invention is to provide a simple and low cost method for imparting excellent hydrogen resistance to various types of articles such as a rare earth metal-based permanent magnet.

Means for Solving the Problems

In the light of above circumstances, the present inventor has made extensive studies, and finally, he has found as a result that a metal coating film formed by pulse plating exhibits excellent hydrogen shielding property.

A method for imparting hydrogen resistance to an article of the present invention that has been accomplished based on the findings above is, in a first embodiment, characterized by forming a metal coating film by pulse plating on the surface of the article.

Further, the method for imparting hydrogen resistance to an article of a second embodiment is a method for imparting hydrogen resistance to an article of the first embodiment, wherein the metal coating film is a Cu coating film.

Further, the method for imparting hydrogen resistance to an article of a third embodiment is a method for imparting hydrogen resistance to an article of the second embodiment, wherein the metal coating film is formed by using a plating solution containing from 0.03 mol/L to 1.0 mol/L of copper sulfate, from 0.05 mol/L to 1.5 mol/L of ethylenediaminetetraacetic acid, and from 0.1 mol/L to 1.0 mol/L of at least one selected from tartrates and citrates, with the pH adjusted to a range of from 10.0 to 13.0.

Further, the method for imparting hydrogen resistance to an article of a fourth embodiment is a method for imparting hydrogen resistance to an article as of the third embodiment, wherein the plating solution further contains from 0.02 mol/L to 1.0 mol/L of sodium sulfate.

Further, the method for imparting hydrogen resistance to an article of a fifth embodiment is a method for imparting hydrogen resistance to an article of the second embodiment, wherein the metal coating film is formed by using a plating solution containing from 0.03 mol/L to 1.0 mol/L of copper sulfate, from 0.05 mol/L to 1.5 mol/L of 1-hydroxyethylidene-1,1-diphosphonic acid, and from 0.01 mol/L to 1.5 mol/L of at least one selected from pyrophosphates and polyphosphates, with the pH adjusted to a range of from 8.0 to 11.5.

Further, the method for imparting hydrogen resistance to an article of a sixth embodiment is a method for imparting hydrogen resistance to an article of the first embodiment, wherein an anticorrosive coating film is further formed on the surface of the metal coating film.

Furthermore, an article resistant to hydrogen of the present invention is, in a seventh embodiment, characterized by having a metal coating film formed on the surface thereof by pulse plating.

Furthermore, the article resistant to hydrogen of an eighth embodiment is an article resistant to hydrogen of the seventh embodiment, wherein the metal coating film has in at least a part thereof multilayered structure constructed by the presence of the grain boundaries of platy crystals.

Furthermore, the article resistant to hydrogen of a ninth embodiment is an article resistant to hydrogen of the eighth embodiment, wherein the platy crystals have preferred orientation with respect to (111) plane and (311) plane.

Furthermore, the article resistant to hydrogen of a tenth embodiment is an article resistant to hydrogen of the seventh embodiment, wherein the article is a rare earth metal-based permanent magnet.

Furthermore, an article resistant to hydrogen of the present invention is, in an eleventh embodiment, characterized by having formed on the surface thereof a metal coating film having in at least a part thereof multilayered structure constructed by the presence of the grain boundaries of platy crystals.

EFFECT OF THE INVENTION

According to the present invention, there can be provided a simple and low cost method for imparting excellent hydrogen resistance to various types of articles such as a rare earth metal-based permanent magnet.

BEST MODE FOR CARRYING OUT THE INVENTION

Figure 1:
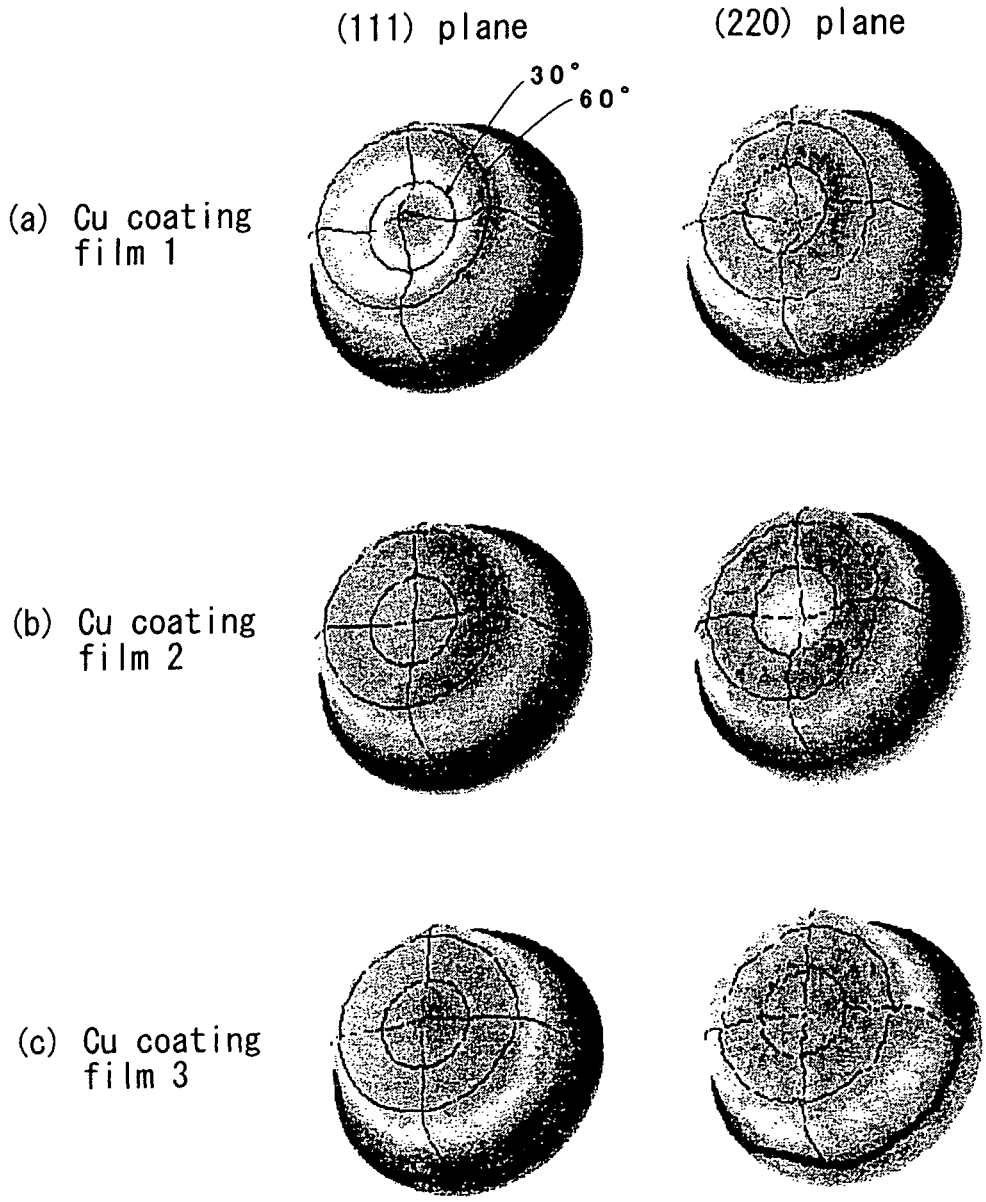
FIG. 1 is polar diagram for (111) plane and (220) plane of Cu coating film 1 to Cu coating film 3 of an example according to the present invention.

A method for imparting hydrogen resistance to an article of the present invention is characterized by forming a metal coating film by pulse plating on the surface of the article. As the metal species which constitutes the metal coating film formed by pulse plating, there can be mentioned Cu, Sn, Zn, Ag, and the alloys containing them, but particularly preferred among them is Cu exhibiting excellent hydrogen shielding property. Because Sn is apt to generate whiskers and Zn is a base metal having restrictions from the viewpoint of corrosion resistance if used alone, precautions should be taken in case Sn or Zn is selected.

In the case of selecting Cu as the metal species which constitutes the metal coating film formed by pulse plating on the surface of an article that is prone to be corroded, such as a rare earth metal-based permanent magnet, the Cu coating film is preferably formed by using a plating solution containing from 0.03 mol/L to 1.0 mol/L of copper sulfate, from 0.05 mol/L to 1.5 mol/L of ethylenediaminetetraacetic acid, and from 0.1 mol/L to 1.0 mol/L of at least one selected from tartrates (such as sodium salts and potassium salts) and citrates (such as sodium salts and potassium salts), with the pH adjusted to a range of from 10.0 to 13.0. Unlike a copper cyanide bath, the plating solution does not contain cyan or other chemical components harmful to environment, or unlike a pyrophosphate bath, the plating solution does not contain free copper ions in high amount which bring about substitution plating reaction on the surface of an article apt to be corroded, therefore it does not easily form a Cu coating film having inferior adhesion strength. A more preferable plating solution contains from 0.05 mol/L to 0.5 mol/L of copper sulfate, from 0.08 mol/L to 0.8 mol/L of ethylenediaminetetraacetic acid, and from 0.1 mol/L to 1.0 mol/L of at least one selected from tartrates (as stated above) and citrates (as stated above), with the pH adjusted to a range of from 11.0 to 13.0. Furthermore, the plating solution may additionally contain from 0.02 mol/L to 1.0 mol/L of sodium sulfate so that a Cu coating film may be formed efficiently free from unevenness. If the amount of addition should be lower than 0.02 mol/L, there is fear of impairing the Cu precipitation efficiency due to reduced electric conductivity of the plating solution; on the other hand, if the amount of addition exceeds 1.0 mol/L, there is fear of making it easier to form unevenness on the Cu coating film. In addition, there may be also added to the plating solution from 0.01 mol/L to 1.0 mol/L of an amino alcohol compound such as ethanolamine, or glycine, polyethylene glycol, and the like as a complexing agent. The addition of such complexing agents is advantageous in the following points. That is, even if free copper ions should generate in the plating solution, complexes are formed to suppress the substitution plating reaction attributed to the presence of free copper ions, thereby effectively preventing the formation of a Cu coating film having inferior adhesion strength. Moreover, because the generation of cuprous oxide is suppressed at the cathode, the formation of a rough Cu coating film is effectively prevented.

In the case of selecting Cu as the metal species which constitutes the metal coating film formed by pulse plating on the surface of an article that is prone to be corroded, such as a rare earth metal-based permanent magnet, the Cu coating film may be formed by using, as a plating solution other than above, a plating solution containing from 0.03 mol/L to 1.0 mol/L of copper sulfate, from 0.05 mol/L to 1.5 mol/L of 1-hydroxyethylidene-1,1-diphosphonic acid, and from 0.01 mol/L to 1.5 mol/L of at least one selected from pyrophosphates (such as sodium salts and potassium salts) and polyphosphates (such as sodium salts and potassium salts), with the pH adjusted to a range of from 8.0 to 11.5. Furthermore, for the purpose of preventing passivation of the anode by smoothing dissolution, of increasing the critical current density, or of reducing plating stress, there may be added to the plating solution from 0.1 mol/L to 1.0 mol/L of, for instance, tartrates (such as sodium salts and potassium salts), citrates (such as sodium salts and potassium salts), and oxalates (such as sodium salts and potassium salts).

Preferably, pulse plating may be carried out, for instance in the case of forming a Cu coating film by using the plating solution above, by applying electric current in pulsed waveform with a maximum current density ($CD_{max}$) in a range of from 1 A/dm$^2$ to 40 A/dm$^2$ and a minimum current density ($CD_{min}$) in a range of from 0 A/dm$^2$ to 5 A/dm$^2$, while maintaining the duration of the maximum current density value ($T_{on}$) for 0.1 ms to 10 ms and the duration of the minimum current density value ($T_{off}$) for 0.5 ms to 10 ms, and under a bath temperature of from 30° C. to 70° C. By employing such conditions, a Cu coating film having superior hydrogen resistance can be obtained with excellent outer appearance free from surface burning and the like.

The thickness of the metal coating film that is formed by pulse plating is preferably 3 μm or thicker. If the film thickness is less than 3 μm, there is fear of insufficiently exhibiting the hydrogen resistance. The upper limit of the film thickness is not particularly limited, but in the case the article is a rare earth metal-based permanent-magnet, it is preferred to set at 20 μm from the viewpoint of assuring effective volume of the magnet or of suppressing the cost.

By further forming an anticorrosive coating film on the surface of the metal coating film formed by pulse plating, the hydrogen resistance can be more surely imparted to an article. The thickness of the anticorrosive coating film is preferably 1 μm or thicker. If the film thickness is less than 1 μm, there is fear of insufficiently exhibiting the effect of forming the coating film. As anticorrosive coating films, preferred are the metal coating films having excellent hydrogen resistance, such as those of Cu, Sn, Zn, Ag, and the alloys containing them, and a DLC film (Diamond Like Carbon film) that is hard and exhibits excellent gas shielding property, and suitable for preventing flaw generation in case the article is a rare earth metal-based permanent magnet and the magnet is used in motors such as IPM. The anticorrosive coating film, which is formed on the surface of the metal coating film formed by pulse plating, is preferably formed by continuous current-applying electric plating without applying electric current in pulsed waveform, or by dry plating. This is because, the formation of a discontinuous plane at a boundary between the metal coating film formed by pulse plating and the anticorrosive coating film formed on the surface thereof further increases the hydrogen shielding property. In the case of using the same metal species for the metal coating film formed by pulse plating and the anticorrosive coating film formed on the surface thereof, it is possible to simplify the process by applying electric current in pulsed waveform at first, and then switching to applying continuous electric current in a single plating bath. Furthermore, the metal coating film formed by pulse plating may be formed either directly on the surface of an article, or on the surface of a lower layer coating film formed on the surface of the article beforehand; for instance, by strike plating or ordinary plating according to a known method.

In the case an anticorrosive coating film is further formed on the surface of the metal coating film formed by pulse plating, or the metal coating film is formed by pulse plating on the surface of a lower layer coating film formed on the surface of an article, and in the case the article is a rare earth metal-based permanent magnet, the total film thickness that is formed on the surface of the magnet is preferably 50 μm or less, and more preferably, 40 μm or less, from the viewpoint of assuring effective volume of the magnet or of suppressing the cost.

The present invention is applicable not only to a rare earth metal-based permanent magnet used in environments of high hydrogen gas pressure, but also to any articles to which hydrogen resistance is required.

EXAMPLES

The present invention is explained in further detail below by way of examples and comparative examples, but it should be understood that the invention is not limited thereto. The examples and comparative examples were carried out by using sintered magnets of 39 mm in length, 20 mm in width, and 3 mm in height, having a composition of 14Nd-0.5Dy-7B-Fe (balance) (in at %) (which are referred to simply hereinafter as "magnet test pieces") prepared according to a process described in, for example, U.S. Pat. Nos. 4,770,723 and 4,792,368; i.e., by pulverizing a known cast ingot and then subjecting the resulting powder to a pressing, a sintering, a heat treatment and a surface working.

Example 1

A nickel (Ni) coating film of 1 μm in thickness was formed on the surface of the magnet test piece by Ni strike plating (Process step 1), and a copper (Cu) coating film of 8 μm in thickness was formed further thereon by Cu pulse plating (Process step 2). Furthermore, in the same plating bath, an application of electric current in pulsed waveform was switched to applying continuous electric current, to thereby form a Cu coating film of 27 μm in thickness on the surface thereof by Cu continuous current-applying electric plating (Process step 3). The plating conditions are as follows.

Process Step 1: Ni Strike Plating

| Bath composition | |
|---|---|
| Nickel sulfate hexahydrate | 130 g/L (0.49 mol/L) |
| Ammonium chloride | 15 g/L (0.28 mol/L) |
| Diammonium citrate | 60 g/L (0.27 mol/L) |
| Boric acid | 15 g/L (0.24 mol/L) |
| Sodium sulfate | 35 g/L (0.25 mol/L) |
| Bath temperature | 50° C. |
| pH | 6.5 (adjusted with 28% ammonia water) |
| Current density | 0.3 A/dm$^2$ |
| Retention method | Rack |

Process Step 2: Cu Pulse Plating

| Bath composition | |
|---|---|
| Copper sulfate pentahydrate | 0.3 mol/L |
| Disodium ethylenediaminetetraacetate | 0.5 mol/L |
| Sodium sulfate | 0.5 mol/L |
| Disodium tartrate | 0.1 mol/L |
| Ethanolamine | 0.1 mol/L |
| Bath temperature | 60° C. |
| pH | 11.5 (adjusted with sodium hydroxide) |
| $CD_{max}$ | 20 A/dm$^2$ |
| $CD_{min}$ | 0 A/dm$^2$ |
| $T_{on}$ | 1 ms |
| $T_{off}$ | 9 ms |
| Retention method | Rack |

Process Step 3: Cu Continuous Current-Applying Electric Plating

Bath composition, bath temperature, and pH are the same as those used in Cu pulse plating (the same plating bath was used).

Current density 1 A/dm$^2$

Retention method Rack

Thus obtained four magnet test pieces (samples) each having a multilayered metal coating film of 36 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

Comparative Example 1

A Ni coating film of 1 μm in thickness was formed on the surface of the magnet test piece by Ni strike plating (under the same conditions as that described in Example 1), and a Cu coating film of 35 μm in thickness was formed further thereon by Cu continuous current-applying electric plating (under the same conditions as that described in Example 1). Thus obtained two magnet test pieces (samples) each having a multilayered metal coating film of 36 μm in total thickness on the surface thereof were subjected to pressurized hydrogen test at 60° C. under 1 MPa, and the time elapsed to disrupt the sample was measured. As a result, both samples were disrupted after 34 hours from the starting of the test.

Analysis and Discussion:

As is clearly understood from Example 1 and Comparative Example 1, although coating films of the same total thickness were provided, hydrogen resistance greatly differed depending on whether a Cu coating film formed by pulse plating was present or not. The results above were analyzed and discussed by the present inventor as follows.

Since the equilibrium internuclear distance $r_0$ in a hydrogen molecule is as small as $r_0$=0.074 nm, in case a defect is present in the coating film, even if it should be a pinhole about several micrometers in size, hydrogen molecules easily reach the surface of the article through the defect. Furthermore, although depending on the type of the counter material, hydrogen molecules are so reactive that they are easily adsorbed and dissociated on the surface of the solid. The atomic hydrogen generated by dissociation of the hydrogen molecule is even smaller, and hence it can be incorporated into molecules or crystals and easily diffused inside the crystal. In order to prevent such hydrogen molecules from reaching the surface of the article, it is crucial to prevent the hydrogen molecules from intruding inside the coating film. From such a point of view, the methods for imparting hydrogen resistance to articles by forming a multilayered metal coating film on the surface thereof as disclosed in Patent reference 1 and Patent reference 2 aim to assure hydrogen shielding property by eliminating pinholes penetrating from the outside to the surface of the article. However, a Ni coating film, which is generally employed as a constituent coating film of forming a multilayered metal coating film because it has high leveling property, is apt to adsorb and dissociate hydrogen molecules on the surface thereof, and is prone to be intruded by atomic hydrogen. Furthermore, a Ni coating film suffers such problems that, because it has relatively high solid solubility for hydrogen, a large hydrogen flux occurs along the depth direction (the direction headed to the surface of the article) after solid solubility for hydrogen reaches a maximum.

On the other hand, differing from a Ni coating film, a Cu coating film is essentially excellent in hydrogen shielding property because less adsorption and dissociation of hydrogen molecules occur on the surface thereof, and solid solubility for hydrogen is relatively small. However, the results above indicate that there are factors in relation with hydrogen shielding property other than the essential property of the Cu coating film. Accordingly, the Cu coating film formed by pulse plating was analyzed in detail to obtain worthy findings never reported to present.

First, the crystal orientation with respect to (111) plane and (220) plane of a Cu coating film (Cu coating film 1) of 8 μm in thickness, which was formed on the surface of the magnet test piece via a Ni coating film of 1 μm in thickness by carrying out the Process steps 1 and 2 in Example 1, was studied from polar diagram obtained by X-ray diffraction under conditions given below. At the same time, crystal orientation was studied in a similar manner as above on a Cu coating film (Cu coating film 2) of 8 μm in thickness, which was formed on the surface of the magnet test piece via a Ni coating film of 1 μm in thickness by carrying out the process under the same conditions as those for Cu coating film 1, except for performing Cu continuous current-applying electric plating at a current density of 1 A/dm$^2$ in the place of Cu pulse plating; and on a Cu coating film (Cu coating film 3) of 8 μm in thickness, which was formed on the surface of the magnet test piece via a Ni coating film of 1 μm in thickness by carrying out the process under the same conditions as those for Cu coating film 1, except for performing Cu continuous current-applying electric plating at a current density of 0.2 A/dm$^2$ in the place of Cu pulse plating and using a barrel in the place of using a rack as the retention method.

| | |
|---|---|
| Power output | 45 kV-40 mA |
| Target | Co-Kα |
| Time/step | 1 s |
| Step width | 5° for φ and 5° for φ |
| Angle range | φ: 0° to 85°, φ: 0° to 355° |
| Symmetrical plane | (111) plane: 2θ = 50.82°<br>(220) plane: 2θ = 88.95° |

The polar diagram for (111) plane and (220) plane for each of Cu coating film 1, Cu coating film 2, and Cu coating film 3 is shown in FIG. 1. FIG. 1 clearly shows that no distinct difference in orientation of (111) reflection and (220) reflection is observed for Cu coating film 2 and Cu coating film 3, but for Cu coating film 1, distinct preferred orientation is observed with respect to (111) reflection. Furthermore, distinct preferred orientation is observed with respect to the plane making an angle of 60° to the (111) reflection. Since Cu crystals are cubic, planes making an angle of about 60° to (111) plane can be (211) plane and (311) plane for cubic. Accordingly, 2θ-θ scanning was performed separately to investigate either of (211) plane and (311) plane corresponds to the observed plane making an angle of about 60° to (111) plane, and was found to be the (311) reflection. The fact that Cu coating film 1 shows preferred orientation with respect to (111) plane and (311) plane was also confirmed by a separately taken cross section FE-SEM photograph of Cu coating film 1. Based on these findings, it has been assumed that the reason why Cu coating film 1 exhibits excellent hydrogen shielding property is because of the special crystal orientation showing preferred orientation with respect to (111) plane and (311) plane, which is different from the crystal orientation of Cu coating film 2 and Cu coating film 3.

Figure 2:
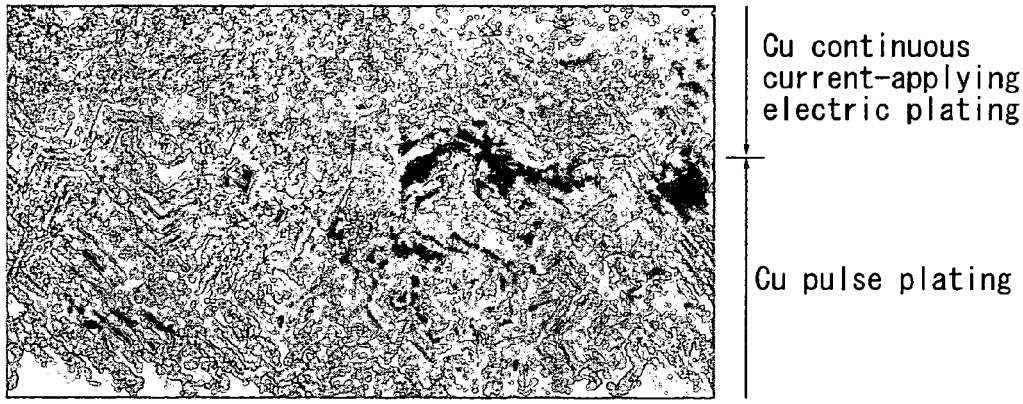
FIG. 2 is an FE-SEM photograph of a partial cross section for the multilayered Cu coating film of an example according to the present invention.
Figure 3:
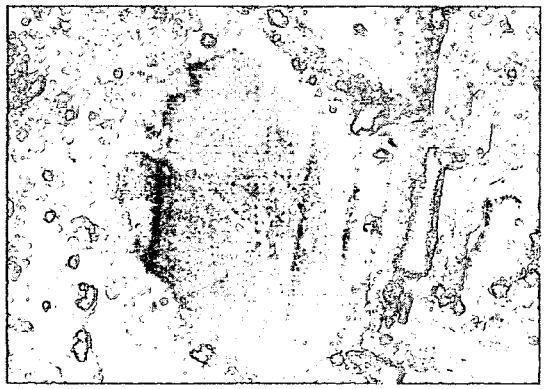
FIG. 3 is an FE-SEM photograph of a partial surface for the Cu coating film formed by pulse plating of an example according to the present invention.

Next, a Ni coating film of 1 μm in thickness was formed on the surface of the magnet test piece by Ni strike plating (under the same conditions as that described in Example 1), and a Cu coating film of 4 μm in thickness was formed further thereon by Cu pulse plating (under the same conditions as that described in Example 1). Furthermore, in the same plating bath, an application of electric current in pulsed waveform was switched to applying continuous electric current, to thereby form a Cu coating film of 4 μm in thickness on the surface thereof by Cu continuous current-applying electric plating (under the same conditions as that described in Example 1). FIG. 2 is a cross section FE-SEM photograph (magnification: 8,500 times) showing the vicinity of a boundary between the Cu coating film formed by pulse plating and the Cu plating film formed by continuous current-applying electric plating, which are constituent coating films of the multilayered metal coating film of 9 μm in total thickness and formed in the manner above on the surface of the magnet test piece. FIG. 2 clearly shows that the Cu coating film formed by pulse plating comprises, in at least a part, randomly distributed multilayered structure constructed by the presence of the grain boundaries of platy crystals, and that the platy crystals are in flattened shape, approximately 1 μm to 10 μm in major axis, 10 nm to 300 nm in thickness, and 10 to 1000 in aspect ratio. Furthermore, the magnet test piece was drawn out from the plating solution at the stage the Cu coating film was formed by Cu pulse plating on the surface of the Ni coating film, and the surface thereof was subjected to FE-SEM photographing after etching it for several tens of seconds by using a 1:1 mixed acid of nitric acid and acetic acid. It was thereby confirmed that platy crystals were present on the surface (see FIG. 3, magnification: 40,000 times). Such a structure of the Cu coating film formed by pulse plating is also believed to contribute to the excellent hydrogen shielding property of the coating film. The following reasons can be mentioned as the reason for above. That is, it was assumed that, when solid solubility for hydrogen reaches a maximum, a hydrogen flux occurs along the depth direction, but because the platy crystals prevents the flux at each grain boundary, the gradual lowering of hydrogen concentration with respect to the external hydrogen gas pressure is further enhanced, and finally, hydrogen molecules are effectively shielded from reaching the surface of the magnet test piece. Furthermore, it was predicted that the random multilayered structure effectively suppresses the generation of penetrated pinholes, and this was also assumed to function effectively in exhibiting hydrogen shielding property.

Example 2

Under the same plating conditions as those of Example 1, a Ni coating film of 1 μm in thickness was formed on the surface of the magnet test piece by Ni strike plating, and a Cu coating film of 8 μm in thickness was formed further thereon by Cu pulse plating. Furthermore, in the same plating bath, an application of electric current in pulsed waveform was switched to applying continuous electric current, to thereby form a Cu coating film of 10 μm in thickness on the surface thereof by Cu continuous current-applying electric plating.

Thus obtained five magnet test pieces (samples) each having a multilayered metal coating film of 19 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

Example 3

Under the plating conditions below, a Cu coating film of 1 μm in thickness was formed on the surface of the magnet test piece by Cu strike plating (Process step 1), and under the same plating conditions as those of Process steps 2 and 3 of Example 1, a Cu coating film of 8 μm in thickness was formed further thereon by Cu pulse plating. Furthermore, in the same plating bath, an application of electric current in pulsed waveform was switched to applying continuous electric current, to thereby form a Cu coating film of 27 μm in thickness on the surface thereof by Cu continuous current-applying electric plating.

Process Step 1: Cu Strike Plating

| Bath composition | |
|---|---|
| Copper sulfate pentahydrate | 0.06 mol/L |
| 1-Hydroxyethylidene-1,1-diphosphonic acid | 0.15 mol/L |
| Potassium pyrophosphate | 0.2 mol/L |
| Bath temperature | 60° C. |
| pH | 10 (adjusted with sodium hydroxide) |
| Current density | 1 A/dm$^2$ |
| Retention method | Rack |

Thus obtained five magnet test pieces (samples) each having a multilayered metal coating film of 36 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

Example 4

A Cu coating film of 1 μm in thickness was formed on the surface of the magnet test piece by Cu strike plating under the same plating conditions as that of Process step 1 of Example 3, and under the plating conditions below, a Cu coating film of 8 μm in thickness was formed further thereon by Cu pulse plating (Process step 2). Furthermore, in the same plating bath, an application of electric current in pulsed waveform was switched to applying continuous electric current, to thereby form a Cu coating film of 27 μm in thickness on the surface thereof by Cu continuous current-applying electric plating (Process step 3).

Process Step 2: Cu Pulse Plating

| Bath composition | |
|---|---|
| Copper sulfate pentahydrate | 0.3 mol/L |
| 1-Hydroxyethylidene-1,1-diphosphonic acid | 0.5 mol/L |
| Potassium pyrophosphate | 0.2 mol/L |
| Bath temperature | 60° C. |
| pH | 10 (adjusted with sodium hydroxide) |
| $CD_{max}$ | 20 A/dm$^2$ |
| $CD_{min}$ | 0 A/dm$^2$ |
| $T_{on}$ | 1 ms |
| $T_{off}$ | 9 ms |
| Retention method | Rack |

Process Step 3: Cu Continuous Current-Applying Electric Plating

Bath composition, bath temperature, and pH are the same as those used in Cu pulse plating (the same plating bath was used).

Current density 1 A/dm$^2$

Retention method Rack

Thus obtained five magnet test pieces (samples) each having a multilayered metal coating film of 36 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

Example 5

A tin (Sn) coating film of 5 μm in thickness was formed by semibright Sn plating on the outermost surface of the magnet test piece prepared in Example 2, having on the surface thereof a multilayered metal coating film of 19 μm in total thickness. The semibright Sn plating was carried out by using SOFT ALLOY GTC-21 (commercially available product of C. Uyemura & Co., Ltd.) at a bath temperature of 30° C., a current density of 2 A/dm$^2$, and by retaining using a rack.

Thus obtained five magnet test pieces (samples) each having a multilayered metal coating film of 24 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

Example 6

A Cu coating film of 1 μm in thickness was formed on the Surface of the magnet test piece by Cu strike plating under the same plating conditions as that of Process step 1 of Example 3, and under the plating conditions below, a Cu coating film of 8 μm in thickness was formed further thereon by Cu pulse plating (Process step 2). Furthermore, under the plating conditions below, a Cu coating film of 20 μm in thickness was formed on the surface thereof by Cu continuous current-applying electric plating (Process step 3).

Process Step 2: Cu Pulse Plating

| Bath composition | |
|---|---|
| Copper sulfate pentahydrate | 0.3 mol/L |
| 1-Hydroxyethylidene-1,1-diphosphonic acid | 0.5 mol/L |
| Potassium pyrophosphate | 0.5 mol/L |
| Disodium tartrate | 0.1 mol/L |
| Bath temperature | 60° C. |
| pH | 10 (adjusted with sodium hydroxide) |
| $CD_{max}$ | 5 A/dm$^2$ |
| $CD_{min}$ | 0 A/dm$^2$ |
| $T_{on}$ | 4 ms |
| $T_{off}$ | 6 ms |
| Retention method | Rack |

Process Step 3: Cu Continuous Current-Applying Electric Plating

| Bath composition | |
|---|---|
| Copper pyrophosphate | 0.25 mol/L |
| Potassium pyrophosphate | 0.9 mol/L |
| Ammonia | 2 mL/L |
| Bath temperature | 60° C. |
| pH | 8.6 (adjusted with potassium hydroxide) |
| Current density | 3 A/dm$^2$ |
| Retention method | Rack |

Thus obtained five magnet test pieces (samples) each having a multilayered metal coating film of 29 μm in total thickness on the surface thereof were subjected to pressurized hydrogen test at 60° C. under 1 MPa, and the time elapsed to disrupt the sample was measured. As a result, no sample disruption occurred even after 2000 hours from the starting of the test.

INDUSTRIAL APPLICABILITY

The present invention has industrial applicability in the point that it provides a simple and low cost method for imparting excellent hydrogen resistance to various types of articles such as a rare earth metal-based permanent magnet.

The invention claimed is:

1. A method for imparting hydrogen resistance to an article, comprising the step of forming a Cu coating film by pulse plating on the surface of the article, wherein the Cu coating film is formed by using a plating solution containing from 0.03 mol/L to 1.0 mol/L of copper sulfate, from 0.05 mol/L to 1.5 mol/L of ethylenediaminetetraacetic acid, and from 0.1 mol/L to 1.0 mol/L of at least one selected from tartrates and citrates, with the pH adjusted to a range of from 10.0 to 13.0.

2. The method for imparting hydrogen resistance to an article as claimed in claim 1, wherein the plating solution further contains from 0.02 mol/L to 1.0 mol/L of sodium sulfate.

3. A method for imparting hydrogen resistance to an article, comprising the step of forming a Cu coating film by pulse plating on the surface of the article, wherein the Cu coating film is formed by using a plating solution containing from 0.03 mol/L to 1.0 mol/L of copper sulfate, from 0.05 mol/L to 1.5 mol/L of 1-hydroxyethylidene-1,1-diphosphonic acid, and from 0.01 mol/L to 1.5 mol/L of at least one selected from pyrophosphates and polyphosphates, with the pH adjusted to a range of from 8.0 to 11.5.

4. A method for imparting hydrogen resistance to an article, comprising the step of forming a metal coating film by pulse plating on the surface of the article, wherein an anticorrosive coating film is further formed on the surface of the metal coating film.

* * * * *